US007148632B2

(12) United States Patent
Berman et al.

(10) Patent No.: US 7,148,632 B2
(45) Date of Patent: Dec. 12, 2006

(54) LED LIGHTING SYSTEM

(75) Inventors: George Berman, Plano, TX (US); Jerry Haden Graves, Valley View, TX (US); John Bartholomew Gunter, Flower Mound, TX (US)

(73) Assignee: Luminator Holding, L.P., Plano, TX (US)

( * ) Notice: Subject to any disclaimer, the term of this patent is extended or adjusted under 35 U.S.C. 154(b) by 61 days.

(21) Appl. No.: 10/345,060

(22) Filed: Jan. 15, 2003

(65) Prior Publication Data

US 2004/0135522 A1 Jul. 15, 2004

(51) Int. Cl.
*H05B 37/00* (2006.01)
*F21S 4/00* (2006.01)

(52) U.S. Cl. ..... 315/189; 362/800

(58) Field of Classification Search ..... 340/912, 340/925, 916; 362/249, 800, 226; 313/512, 313/505; 315/184, 185 R, 185 S, 189, 191
See application file for complete search history.

(56) References Cited

U.S. PATENT DOCUMENTS 4,298,869 A * 11/1981 Okuno ..... 345/82
5,138,310 A * 8/1992 Hirane et al. ..... 345/82
5,457,450 A * 10/1995 Deese et al. ..... 340/912
5,806,965 A * 9/1998 Deese ..... 362/249
6,239,716 B1 * 5/2001 Pross et al. ..... 340/815.4
6,292,901 B1 * 9/2001 Lys et al. ..... 713/300
6,461,019 B1 * 10/2002 Allen ..... 362/249
6,498,440 B1 * 12/2002 Stam et al. ..... 315/291
6,583,731 B1 * 6/2003 Chan et al. ..... 340/931
6,659,622 B1 * 12/2003 Katogi et al. ..... 362/219
6,693,556 B1 * 2/2004 Jones et al. ..... 340/907
6,717,376 B1 * 4/2004 Lys et al. ..... 315/292

* cited by examiner

*Primary Examiner*—Don Wong
*Assistant Examiner*—Minh Dieu A
(74) *Attorney, Agent, or Firm*—Darby & Darby

(57) ABSTRACT

A lighting device that can generate light of variable color and intensity under processor control. Multiple lighting devices of a modular design can be incorporated into a lighting system to illuminate larger areas. A lighting module includes three groups of LEDs each of which generates light of a different color whose intensity can be controlled. A lighting system can be formed by coupling multiple lighting devices to a central controller comprising an operator interface panel and an interface to an external computer. The external computer can be provided with programming tools that allow the creation of lighting programs for controlling the operation of the lighting system. A user can select programs or modify the operation of the lighting system from the operator interface panel provided at the central controller or from the external computer. Procedures are provided for calibrating the color and power output of each lighting device.

12 Claims, 11 Drawing Sheets

FIG. 8B

| FEATURE | DESCRIPTION |
|---|---|
| DISPLAY SCREEN | Displays scrolled menu selections. Used for selecting and displaying desired lighting. Also used for selecting maintenance options after "MAINT" key is selected. |
| RESET | Pressing and holding for 5 seconds initiates a software reboot. Reset does not effect current completed light setting. Reset during light transition causes lights to revert to last completed light setting. |
| UP ARROW | Allows operator to scroll upward through menu selection until desired lighting or maintenance option is aligned with selection indicator |
| DOWN ARROW | Allows operator to scroll downward through menu selection until desired lighting or maintenance option is aligned with selection indicator |
| ENTER | Pressed to initiate selected lighting or maintenance option. |
| MAINTENANCE | **(Accessible only with plane on ground.)** Causes maintenance menu to display. Maintenance menu options are : Part Numbers, Test, and Return. |
| LED INDICATORS | Illuminates when associated light setting is activated. Can be activated by pressing key on this panel or comparable cabin lighting key on cabin services panel |
| NIGHT | Sets ECLS lighting to a uniform low level blue light in ceiling. Sidewall lights are off. |
| LOW | Sets ECLS lighting to dimmed white light. Ceiling lights are OFF. Sidewall lights are at 50% full white light. Can be activated by pressing this key or cabin services panel |
| MEDIUM | Sets ECLS lighting to a diminished white light level. Ceiling lights are at 50% brightness. Sidewall lights are on full white. Can be activated by pressing this key or cabin services panel. |
| HIGH | Sets ECLS lighting to full on white light. Both ceiling and sidewall lights are on full white. Can be activated by pressing key or cabin services panel. |

FIG. 9

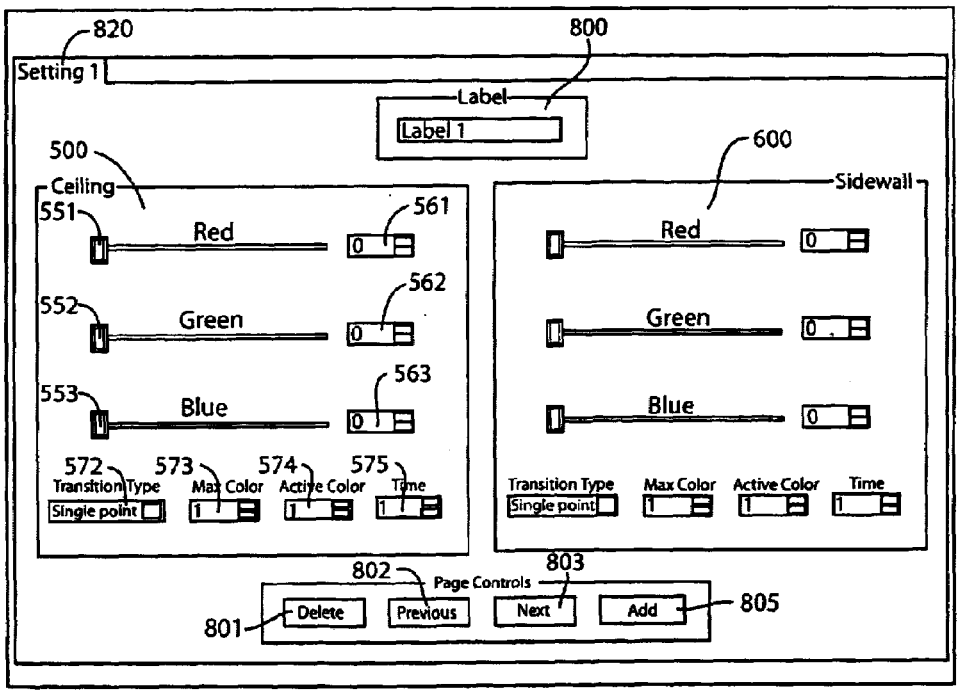

LED LIGHTING SYSTEM

FIELD OF THE INVENTION

The present invention relates to lighting systems employing multiple light emitting diodes (LEDs) to generate light whose color and intensity can be varied under computer control.

BACKGROUND INFORMATION

It is well known that light of different colors, particularly the primary colors red, blue and green, can be combined in various proportions to generate light having a wide variety of colors, including white light. It is also well known to use light emitting diodes (LEDs) for such a purpose. The intensity of light emitted by an LED can be varied by pulse width modulating (PWM) the power applied to the LED. The application of power to an LED or group of LEDs can be controlled by a PWM control signal generated by a microcontroller or the like. The microcontroller can be programmed to control multiple groups of LEDs, each generating light of a different primary color. By controlling the intensity of light generated by each color group of LEDs, the microcontroller can thus control the LEDs to generate a combined light of a specified color and intensity. The microcontroller can carry out such an operation in accordance with a variety of data inputs from sources such as a central controller, a user interface, a measurement device or the like.

SUMMARY OF THE INVENTION

The present invention is directed to an improved lighting device that can generate light of variable color and intensity under processor control. Multiple lighting devices can be incorporated into a lighting system to illuminate larger areas.

In an exemplary embodiment, a lighting device in accordance with the present invention comprises a lighting module which is coupled to one or more additional modules that provide power and control the operation of the lighting module. The lighting module includes three groups of LEDs each of which is comprised of LEDs of the same color. The colors of the three groups are green, red and blue and the LEDs are arranged in a line in a repeating pattern of green, red, green, blue, green, red, green and red.

In a further aspect of the present invention, a lighting system is formed by coupling multiple lighting devices to a central controller comprising an operator interface panel and an interface to an external computer. The external computer can be provided with programming tools in accordance with the present invention that allow the creation of lighting programs for controlling the operation of the lighting system. The lighting programs developed on the external computer can be downloaded to the central controller which then carries out the downloaded programs in conjunction with the lighting devices coupled thereto. A user can select programs or modify the operation of the lighting system from the operator interface panel provided at the central controller. A user can also control the operation of the lighting system directly from the external computer while it is coupled to the central controller.

The present invention also provides methods for calibrating the color and power output of each lighting device.

These and other aspects of the present invention will be described below in greater detail.

BRIEF DESCRIPTION OF THE DRAWINGS

FIGS. 8A and 8B show an exemplary embodiment of an operator interface panel of a lighting system in accordance with the present invention.

FIG. 9 shows an exemplary display of a user interface for programming a lighting system in accordance with the present invention.

DETAILED DESCRIPTION

Figure 1:
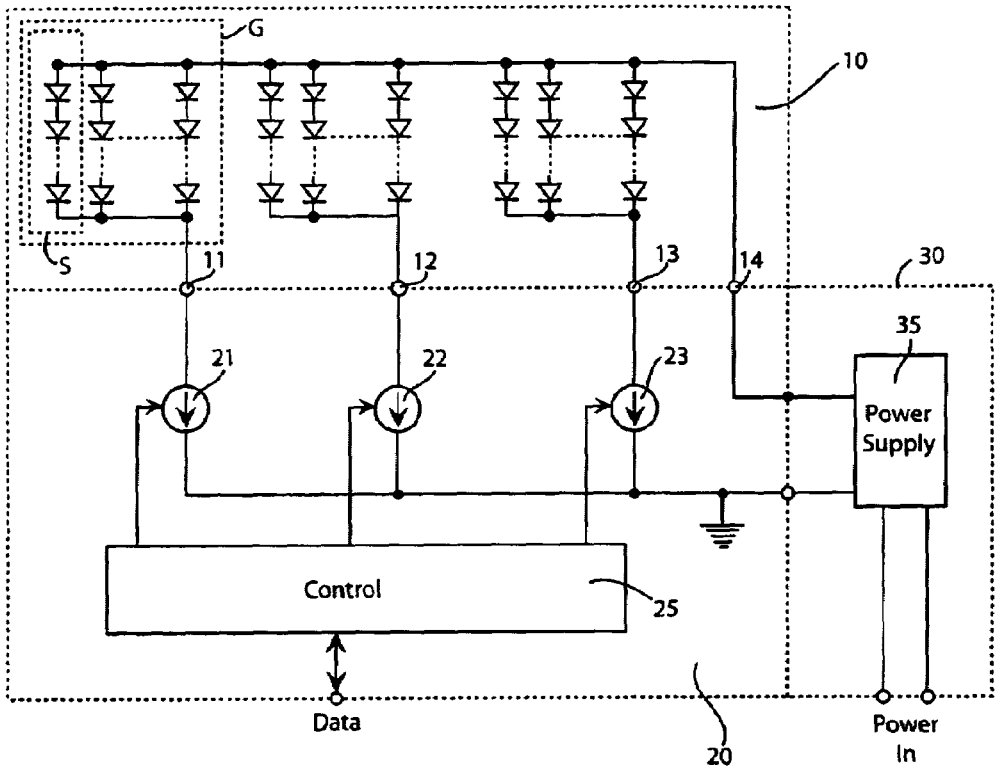
FIG. 1 is schematic representation of an exemplary embodiment of a lighting device in accordance with the present invention.

FIG. 1 shows a block diagram of an exemplary embodiment of a lighting device 100 in accordance with the present invention. In the exemplary embodiment shown, the lighting device 100 comprises a lighting module 10, a control module 20 and a power module 30. The lighting, control and power modules can be combined into one or more modules and may be implemented on one or more circuit boards. The lighting device 100 need not be modular at all.

The lighting module 10 comprises a plurality of light emitting diodes (LEDs) each of which emits green, red or blue light. Naturally, other combinations of colors are possible within the scope of the present invention. For example, green, orange and blue LEDs may be used. In yet a further embodiment, any three colors whose wavelengths are separated by at least some minimum wavelength difference (for example 30 nm) can be used. Furthermore, as can be understood by a person of ordinary skill in the art, aspects of the present invention are applicable to systems with LEDs of any number of different colors including single-color LED applications.

Figure 2:
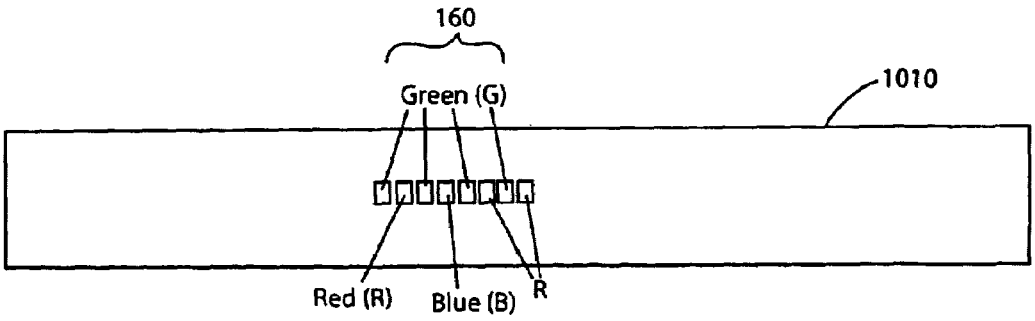
FIG. 2 shows the linear arrangement of LEDs on a lighting module of an exemplary embodiment of a lighting device in accordance with the present invention.

Physically, the LEDs are arranged substantially along a line in a repeating pattern of green, red, green, blue, green, red, green and red. This arrangement is illustrated in FIG. 2. Electrically, the LEDs are grouped by color, wherein the cathodes of the LEDs of a particular color are coupled to a common terminal 11, 12 or 13. The anodes of all of the LEDs are coupled to a common power terminal 14. As can be understood, each of the terminals 11–14 can be implemented using multiple terminals as may be required for current carrying capacity but are described as single terminals for the sake of simplicity.

As shown in FIG. 1, each group (G) of LEDs is comprised of one or more parallel strings (S) of LEDs. Each LED string comprises one or more LEDs connected in series. All of the LEDs within a string preferably emit the same color light. The common cathode of each group of LEDs is coupled to a respective current source 21, 22, and 23 on the control module 20. The common anode of all LEDs on the LED module 10 is coupled to a power supply 35 on the power module 30. The current through each group of LEDs is determined by the respective current source 21–23, each of which is under the control of a control circuit 25 on the control module 20. When on, each of the current sources 21–23 sinks a current that is regulated to be substantially constant. Naturally, as can be readily understood, the polarity of the LEDs and of the power supply and the direction of current flow can be reversed in an alternative embodiment. The control and power circuitry will be described in greater detail below.

The number of LEDs in each string is selected so as to substantially equalize the voltage drop across the multiple LED strings of the LED module. By equalizing the voltage drops across the multiple LED strings, the amount of power wasted in the control module is reduced, thereby improving the efficiency of the device.

Because LEDs of different colors have different forward voltage drops, the preferred number of LEDs in each string depends on the color of the LEDs in that string. Thus, for example, where green and blue LEDs each have a forward voltage drop of approximately 3.2 volts, a string of eight green or blue LEDs will have a voltage drop of approximately 25.6 volts. A string of 12 red LEDs, each of which has a forward voltage drop of 2.1 volts, will have a voltage drop of 25.2 volts.

In an exemplary embodiment, the LED module 10 includes 192 LEDs arranged linearly along a board which is 12.4" long. The 192 LEDs include 96 green LEDs, 72 red LEDs and 24 blue LEDs physically arranged in the repeating pattern of green, red, green, blue, green, red, green and red. The 96 green LEDs are electrically arranged in 12 strings of eight LEDs each; the 72 red LEDs in six strings of 12 LEDs each; and the 24 blue LEDs in three strings of eight LEDs each.

In another exemplary embodiment, an LED module 10 with a board that is 11 inches long has 160 LEDs: 80 green LEDs, 60 red LEDs and 20 blue LEDs physically arranged in the aforementioned repeating pattern of green, red, green, blue, green, red, green and red. As in the previously described embodiment, each string of red LEDs includes 12 LEDs, whereas each string of green or blue LEDs includes eight LEDs. In the case of the blue LEDs, four "ballast" LEDs are added to the 20 LEDs so as to form three full strings of eight LEDs each. The ballast LEDs are obscured so that the light they emit is not combined with that of the other LEDs and thus does not disturb the color emission balance of the lighting module. By thus utilizing ballast LEDs, any combination of LEDs can be arranged in voltage-equalized strings of LEDs while also providing the desired color emission balance.

The ballast LEDs can be obscured by a variety of means, such as by placing them on the side of the circuit board opposite to that on which the other LEDs are placed and/or by applying a dark paint over their emitting surfaces. In order to avoid dark spots in the emission of the LED module, the ballast LEDs preferably are not placed along the line of LEDs whose emissions are visible.

Because different LEDs can have different forward voltages, even if of the same color, some strings of LEDs may not be as bright as other strings of LEDs. To avoid the appearance of dark or bright spots along the row of LEDs, it is desirable to distribute the LEDs of the same string as widely as possible over the LED module. For example, LEDs of the same string must be at least N LEDs apart, where N is at least one.

Physically distributing the LEDs of the same string across the LED board also has the benefit of minimizing the perceived effect of an LED burning out. When an LED burns out, the current in the string in which the LED is coupled is interrupted and all of the LEDs in that string turn off. The LEDs of the same color that are in other strings, however, become brighter as the same amount of current is now shared by fewer LEDs of the same color. By widely distributing the LEDs of each string over the board, the brighter LEDs will compensate for the inactive LEDs and the perception of any bright or dark spots will be minimized.

Figure 3:
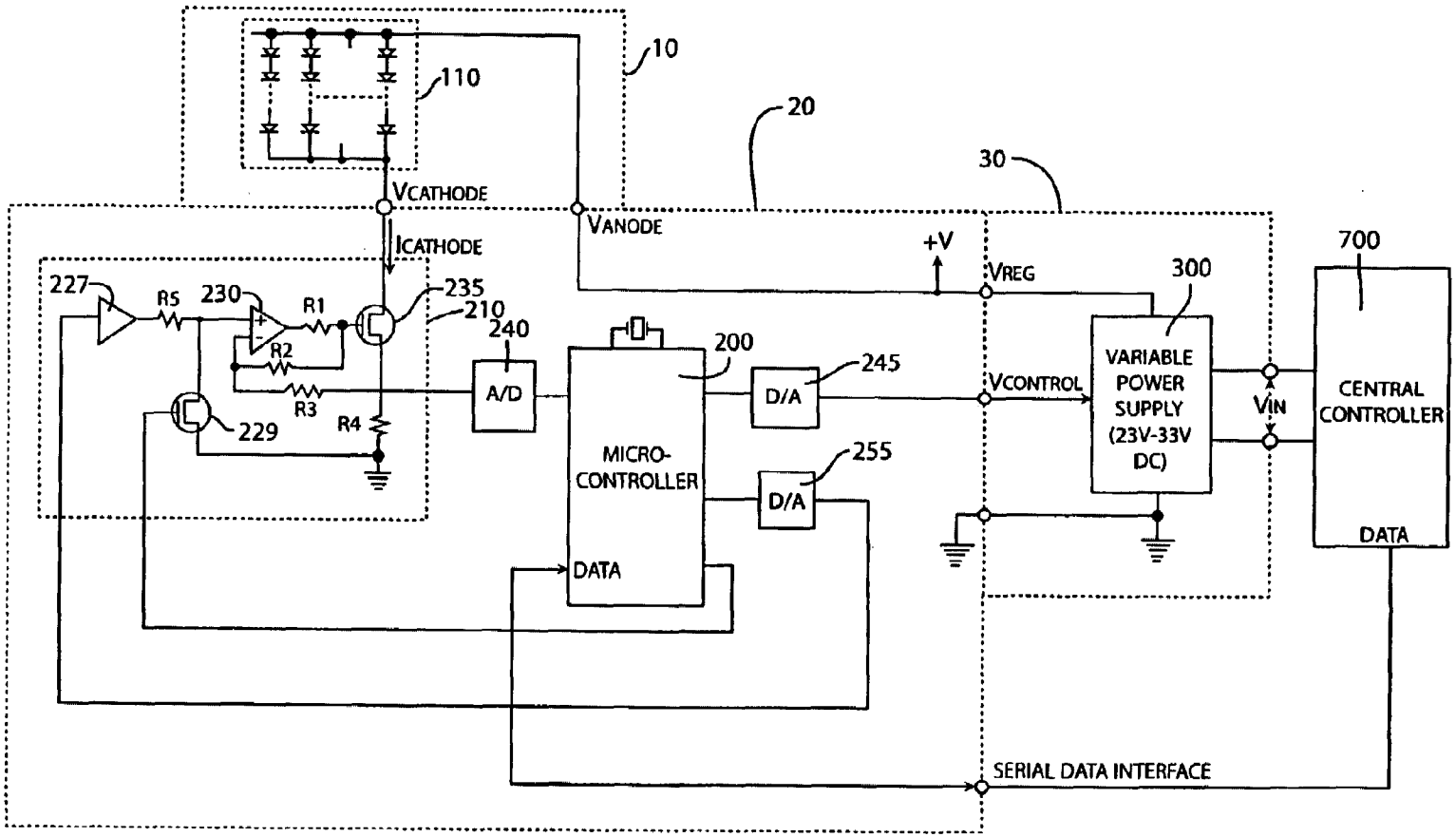
FIG. 3 shows a more detailed schematic representation of an exemplary embodiment of a lighting device in accordance with the present invention.

FIG. 3 shows a block/schematic diagram of an exemplary embodiment of a lighting device 100 in accordance with the present invention. FIG. 3 shows in greater detail the control circuitry for one color group 110 of LEDs. The control circuitry for the remaining color groups is similar and has been omitted for clarity.

The control circuitry, which resides on the control module 20, includes a microcontroller 200 which operates in accordance with a program stored in a memory device (not shown or incorporated in microcontroller 200). The microcontroller 200 may be a single-chip device which includes a CPU and one or more of a random access memory (RAM), read-only memory (ROM) for program storage, non-volatile memory such as EEPROM for storing parameters or settings, one or more digital-to-analog converters, one or more analog-to-digital converters, one or more pulse-width modulators, a serial communications interface, and various other auxiliary functions, such as timers, counters, interrupt handlers and the like. These function can be implemented in one integrated circuit (IC) or with several ICs and discrete components. In an exemplary embodiment, the microcontroller 200 is implemented with a TMS320LF2406A 16-bit Digital Signal Processor (DSP) IC from Texas Instruments of Dallas, Tex.

The microcontroller 200 includes a bidirectional serial data interface for communicating with a central controller 700 (discussed in greater detail below). Over this interface, the microcontroller 200 can receive commands from the central controller 700 specifying the state of operation of each LED group of the device 100. In an exemplary embodiment, the central controller 700 specifies the duty cycle of the power applied to each LED group (thereby specifying the brightness of the light emitted by each LED group and thus the color of the combined light as well.) In response, the microcontroller 200 controls the LED groups accordingly. In an exemplary embodiment, the data interface can be compliant with the RS-485 protocol. In other embodiments, the data interface can alternately be a parallel interface. The data interface may also be wireless (e.g., infrared, radio frequency, etc.)

In the exemplary embodiment shown, the microcontroller 200 includes three on-chip pulse width modulation (PWM) generators, each of which generates a pulse-width modulated signal which is used to control a respective color group of LEDs. The on-chip PWM generators operate in accordance with internal registers under software control. Once the appropriate registers have been set, the PWM generators carry out the generation of the respective control signals without involving the CPU, thus freeing the CPU to perform other functions. Naturally, as can be understood by a person of ordinary skill, other implementations are also possible within the scope of the present invention, including, among others, a CPU-intensive bit-banging implementation, or an interrupt-driven implementation using one of the internal timers. The PWM generators can also be implemented with dedicated hardware and controlled by the microcontroller 200.

Figure 4:
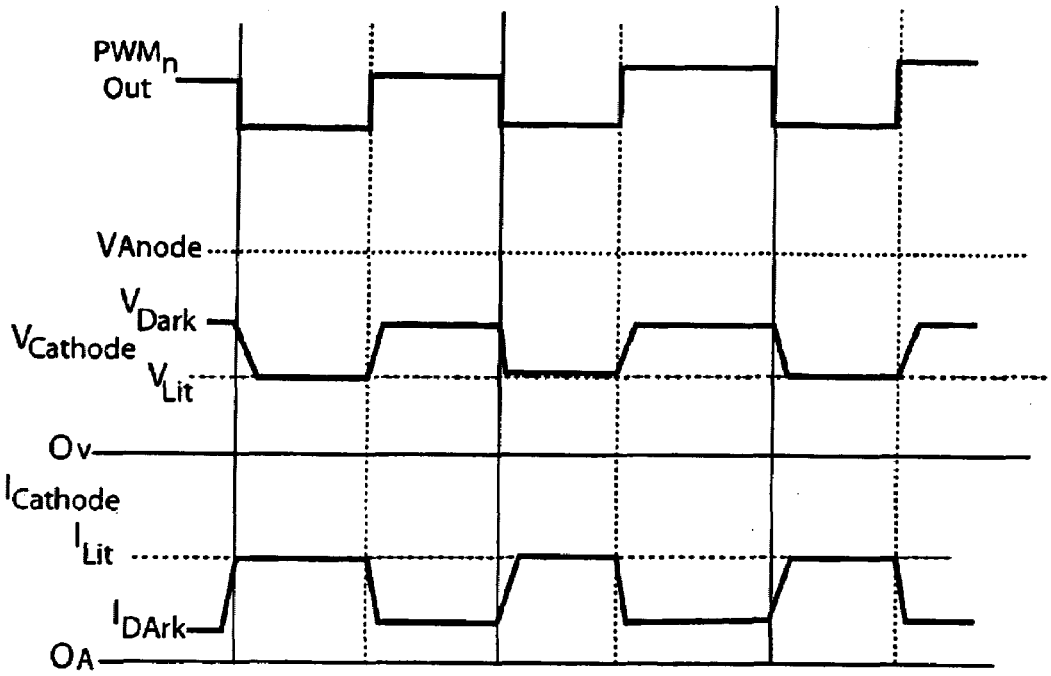
FIG. 4 shows the control signal, common cathode voltage and common cathode current for a group of LEDs of an exemplary embodiment of a lighting device in accordance with the present invention.

A control circuit 210 controls the activation of LED color group 110 under the control of the microcontroller 200. The control circuit 210 acts as a constant current source which can be switched on or off by the respective PWM control signal (PWMn) generated by the microcontroller 200. FIG. 4 shows the voltage at the common cathode of the LED color group 110, Vcathode, and the current through the common cathode of the LED color group 110, Icathode, with respect to the PWM control signal generated by the microcontroller 200. As described above, the anodes of all LEDs are coupled together at a common anode. The voltage at the anode, Vanode, is coupled via the control module 20 to the regulated power supply output voltage Vreg.

As shown in FIG. 4, when the PWM control signal is in the ON state (in the illustrated case a logic "1" or high), the LEDs of the color group are turned on as the cathode voltage drops to Vlit and the cathode current rises to Ilit. When the PWM signal is in the OFF state, the LEDs of the color group are turned off, as the cathode voltage rises to Vdark and the cathode current drops to Idark.

In an exemplary embodiment of the present invention, the control circuit 210 operates so that when the LEDs of the group 110 are dark, or not emitting any perceptible light, the LEDs are nonetheless conducting some current so that the combined current for the group 110, Idark, is greater than zero, as shown in FIG. 4 This causes the common cathode voltage Vdark to be less than the anode voltage since there is a voltage drop across each LED in the group. In a conventional arrangement in which the LEDs do not conduct at all when off, Vdark would be higher, substantially equal to the anode voltage. By thus reducing the amplitude of the cathode voltage swing between the active (or lit) and inactive (or dark) states of the LEDs, the stress to which the LEDs are subjected is reduced, thereby increasing their longevity. Furthermore, the slew rate of the voltage transition between the active and inactive states is reduced, thereby reducing the high frequency components in the voltage signal and thus the electrical noise emitted by the lighting device of the present invention.

The magnitude of the cathode current in the lit state, Ilit, is controlled by the microcontroller 200 via a digital-to-analog (D/A) converter 225. The output of the D/A converter 225 is coupled to a buffer 227 whose output controls a voltage-controlled current source comprising an operational amplifier (op-amp) 230, a MOSFET 235 and resistors R1–R4.

The amount of current conducted by the MOSFET 235 is controlled by the voltage applied to the non-inverting input of the op-amp 230 so that the larger the input voltage, the greater the current. Icathode, the current conducted by the MOSFET 235, is substantially equal to the voltage at the non-inverting input of the op-amp 230 divided by the value of R4.

A MOSFET 229 is arranged at the output of the buffer 227 so that when the PWM control signal is low (logic 0), the MOSFET 229 is off and the voltage generated by the buffer 227 is provided unattenuated to the non-inverting input of the op-amp 230. This causes the current through the MOSFET 235 to be Ilit.

When the PWM control signal is high (logic 1), the MOSFET 229 turns on, shunting the output of the buffer 227 through R5 to ground and attenuating the voltage at the non-inverting input of the op-amp 230. This causes the current through the MOSFET 235 to be Idark. The value of Ilit is substantially equal to the unattenuated voltage at the output of the buffer 227, which is set by the microcontroller via the D/A converter 225, divided by the value of R4. The microcontroller 200 can set the value of Ilit in accordance with the number of LED strings in the respective LED group 110. This allows the use of LED modules 10 of different sizes (i.e., different numbers of LED strings) with the same control module 20. The microcontroller 200 can also set the value of Ilit to calibrate the power provided to the LEDs.

The value of Idark is substantially equal to the voltage at the output of the buffer 227 attenuated by the combination of R5 and the conducting resistance of MOSFET 229, divided by the value of R4. As discussed above, Idark is selected so as to reduce the noise generated by the switching of the LEDs and to reduce the switching stresses on the LEDs. As with Ilit, the microcontroller 200 can control the value of Idark by controlling the voltage at the output of the buffer 227 via the D/A 225.

In an exemplary embodiment, the current through each LED string when lit is substantially 40 mA. In the case of a 12.4" long LED module with 96 green LEDs organized in 12 strings of eight LEDs each, the microcontroller 200 controls the voltage-controlled current source 210 to sink a cathode current of 12×40 mA, or 480 mA, when the green LEDs are on. Thus the desired value of Ilit is 480 mA. With R4 having a resistance of 1.25 ohm, the voltage at the output of the buffer 227 should be 1.25×0.480=0.600 volts. Therefore, the microcontroller 200 is programmed so that when a 12.4" LED module 10 with 96 green LEDs is coupled to the control module 20, the microcontroller 200 controls the D/A converter 245 to generate a voltage of 0.600 volts at the output of the buffer 227, which in turn causes the MOSFET 235 to conduct a current of 480 mA. The 480 mA current is shared by 12 strings of LEDs, each string conducting 40 mA, as desired.

In an exemplary embodiment in which the MOSFET 229 has a conducting resistance of 4 ohms and the resistor R5 has a value of 20 kohms, the output of the buffer 227 is attenuated to 1 mV at the input to the op-amp 230. If the op-amp 230 has an input bias offset voltage of approximately 0.360 mV, Idark is approximately:

$$(1\ \text{mv}+0.360\ \text{mV})/1.25\ \text{ohm}=1.088\ \text{mA}.$$

Distributed over 12 strings, each string conducts 1.088 mA/12=90 μA.

The current through the common cathode of the LED color group 110 is monitored by the microcontroller 200 via an analog-to-digital (A/D) converter 240. The input of the A/D converter 240 senses the voltage across R4, which is substantially proportional to the cathode current. The microcontroller 200 monitors the cathode current of each LED color group using a similar arrangement for each group. The microcontroller 200 uses the current information in performing a power calibration procedure described below.

In an exemplary embodiment of a lighting device in accordance with the present invention, one control module 20 can be coupled to and control multiple lighting modules 10. In this case, the control circuitry 210 is replicated for each LED group. For example, in an exemplary embodiment with three LED modules 10, the control module 20 will have nine groups of LEDs. The TMS320LF2406A DSP is well suited in this case for use as the microcontroller 200 as it includes nine, on-chip PWM generators as well as multiple A/D converters that can sample the nine current sensing points in such a device.

In a further aspect of an exemplary embodiment of the present invention, the power module 30 comprises a variable power supply 300. The power supply 300 takes in a voltage Vin from the central controller 700 and generates a regulated DC voltage Vreg which can be varied in accordance with a control voltage Vcontrol. Vcontrol is generated on the control module by a D/A converter 245 coupled to the microcontroller 200. The microcontroller can thus control the regulated output of the power module 30 over a given range. The regulated output of the power module 30 is routed via the control module 20 to the LED module 10 as the common anode voltage, Vanode. (Naturally, Vreg can alternately be directly coupled from the power module 30 to the common anode of the LED module 10.)

In an exemplary embodiment, Vin is nominally 28 volts DC and Vreg can be 23 to 33 volts DC. The variable power supply 300 can be implemented in a conventional way.

As described above, the microcontroller 200 can measure the cathode current for each LED color group as well as control the common anode voltage Vanode. The microcontroller 200 can be programmed to use these capabilities to carry out a power calibration procedure in accordance with the present invention. In an exemplary procedure, the microcontroller 200 initially sets Vanode (Vreg) close to the bottom end of its range of adjustability, e.g., 24 volts. The microcontroller 200 then turns on each LED group and measures the common cathode current for each LED group. If the cathode current for each LED group is not at least some minimum predetermined current for that group, the microcontroller 200 then adjusts the Vcontrol to increase Vanode by at least some predetermined increment, e.g., 0.25 volts. The minimum predetermined current for each LED color group is equal to a minimum predetermined current for each string of LEDs multiplied by the number of LED strings of that color group. In an exemplary embodiment, the average current through each LED string is 40 mA, with a variation of ±10%; i.e., a minimum current of 36 mA and a maximum of 44 mA. If there are 12 strings in the green LED group, for example, the minimum current for the green LED group is 36×12 or 432 mA. Similarly, for six strings of red LEDs and three strings of blue LEDs, the minimum currents would be 216 mA and 108 mA, respectively. If in this exemplary arrangement the microcontroller 200 does not sense at least 432 mA, 216 mA and 108 mA in the green, red and blue LED groups, respectively, the microcontroller will then increase Vanode and re-measure the cathode currents of each group, as before. The microcontroller 200 repeats this iterative process until the aforementioned minima are met or exceeded for all three LED color groups.

Figure 5:
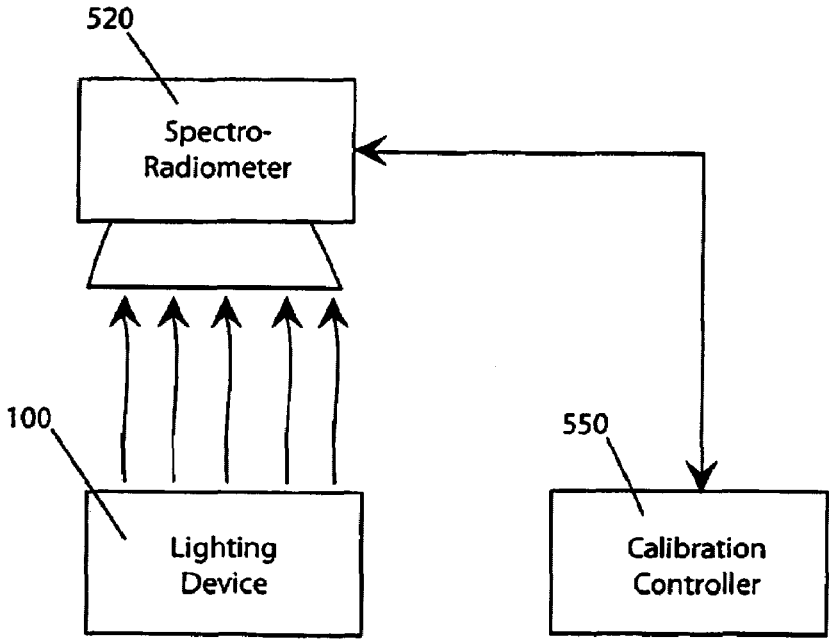
FIG. 5 shows an arrangement for an exemplary color calibration method in accordance with the present invention.
Figure 6:
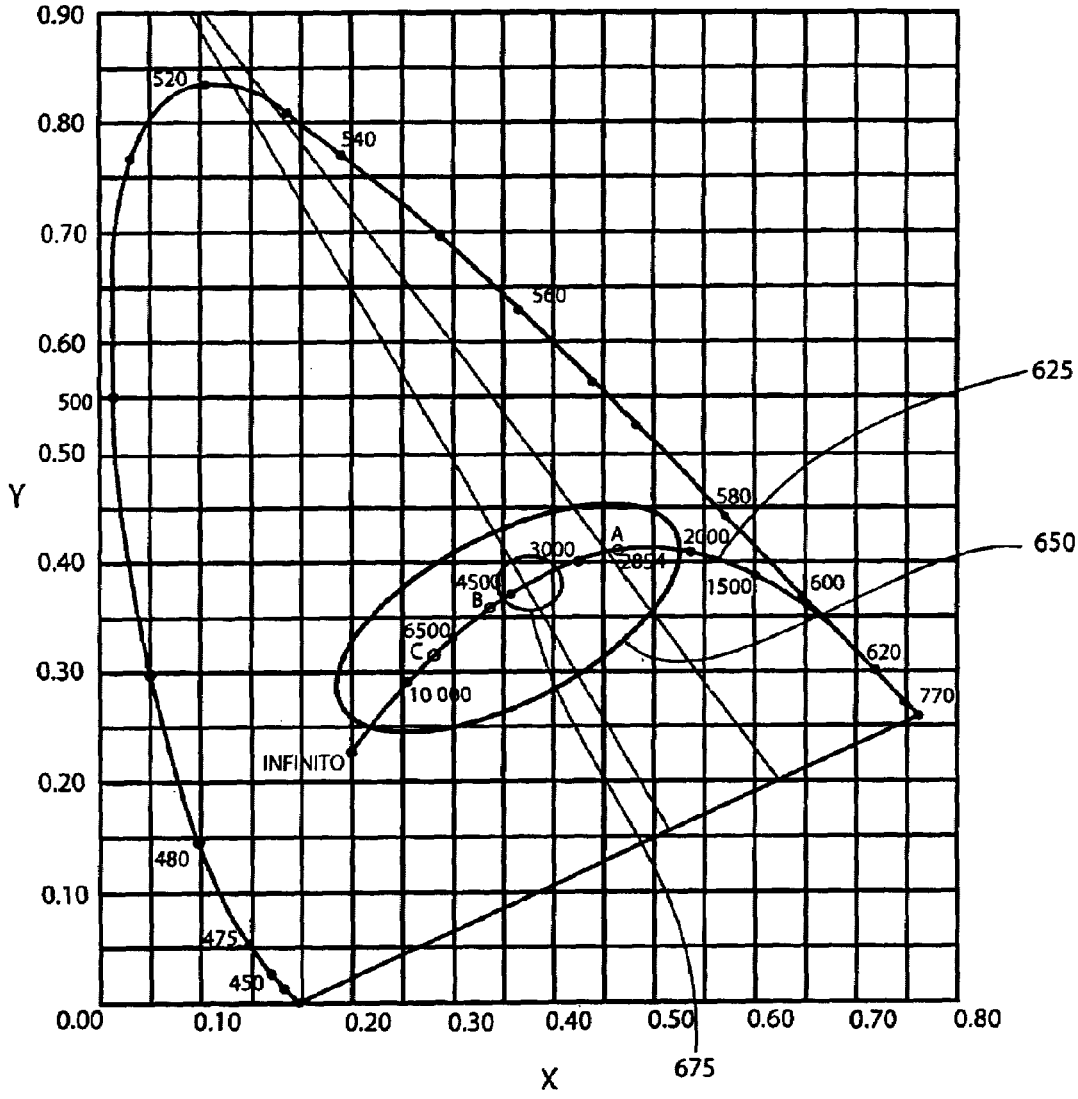
FIG. 6 shows a chromaticity diagram for illustrating the exemplary color calibration method of the present invention.

An exemplary method of calibrating the color emitted by a lighting device of the present invention will now be described with reference to FIGS. 5 and 6. FIG. 5 shows an exemplary calibration setup in which a lighting device 100 to be calibrated emits light which is detected by a spectro-radiometer 520. The spectro-radiometer 520 determines the color rendering index (CRI) and the correlated color temperature (CCT) of the light detected. The spectro-radiometer 520 is coupled to a calibration controller 550 which is in turn coupled to the lighting device 100 via the above-described data interface. The calibration controller 550 may comprise a personal computer with the appropriate software and interfaces for interacting with the spectro-radiometer 520 and the lighting device 100.

In an exemplary method of the present invention, the calibration controller 550 initially controls the lighting device 100 to generate white light by specifying the appropriate duty cycles with which the red, blue and green LEDs of the lighting device 100 are to be energized in order for their combined output to appear as white light. In an alternate embodiment, the calibration controller 550 initially controls the lighting device 100 to generate all three colors with maximum intensity: i.e., the duty cycle specified for each of the red, green and blue LED groups is at its maximum value.

The spectro-radiometer 520 then determines the CRI and CCT of the light emitted by the lighting device 100 and communicates those results to the calibration controller 550. The calibration controller 550, in turn, determines whether the measured CRI and CCT are acceptable. In an exemplary embodiment, a CRI of 60 to 100 is considered acceptable and a CCT of approximately 4000 Kelvin is sought. If not acceptable, the calibration controller 550 adjusts the duty cycles of the red, green and blue LEDs of the lighting devices. The light output of the device 100 is measured again and the process is repeated until the CCT and CRI values measured fall within the above-mentioned ranges.

The spectro-radiometer 520 may also determine the components of the color of the light generated by the device 100 which components can be used in an alternate color calibration procedure. FIG. 6 shows a chromaticity diagram which helps illustrate the color calibration process of the present invention. The chromaticity diagram of FIG. 6 is an x, y chromaticity diagram which projects the cone of visible light onto the x, y tristimulus plane. A region 650 of the chromaticity diagram represents white light. The region 650 surrounds the black body curve 625. The white light output desired falls within a predetermined target area 675 within the region 650 on or near the curve 625.

In an exemplary calibration procedure of the present invention, the calibration controller 550 initially controls the lighting device 100 to generate all three colors with maximum intensity. The spectro-radiometer 520 then determines the x and y tristimulus components (i.e., the location on the chromaticity diagram of FIG. 6) of the light emitted by the lighting device 100 and communicates those results to the calibration controller 550. The calibration controller 550, in turn, determines whether the measured x and y components represent a point within the predetermined target area 675. If not, the calibration controller 550 adjusts the duty cycles of the red, green and blue LEDs of the lighting devices accordingly. The light output of the device 100 is measured again and the process is repeated until the measured tristimulus components represent a point within the predetermined target area 675. At that point, the x, y and z tristimulus values (where x+y+z=1) are used to determine the relative intensities of the LED color groups in order to achieve the calibrated white light.

A lighting system comprising multiple lighting devices in accordance with the present invention will now be described.

Figure 7:
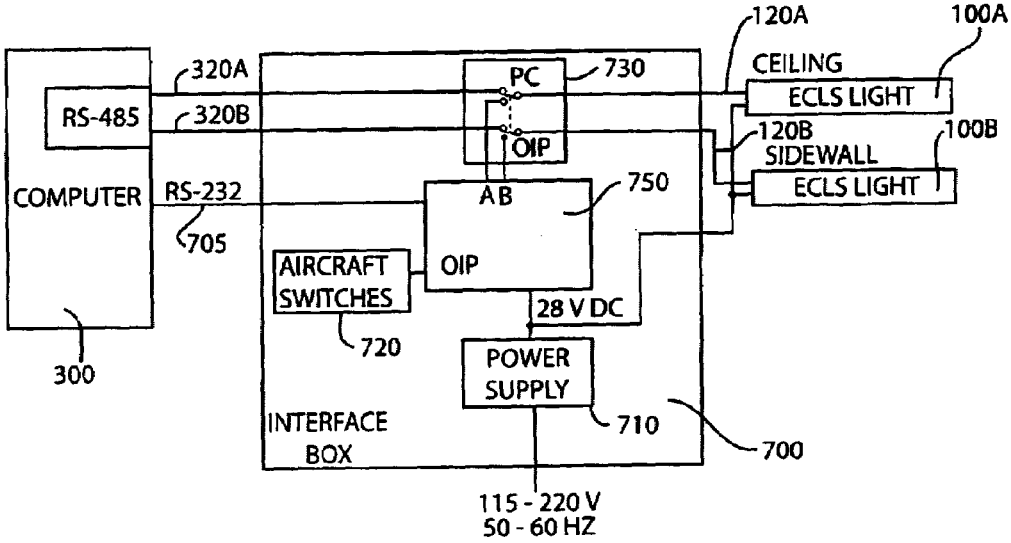
FIG. 7 shows a block diagram of an exemplary embodiment of a lighting system in accordance with the present invention.

FIG. 7 shows a block diagram of an exemplary lighting system comprising lighting devices 100A and 100B and a central controller 700 coupled thereto. The central controller 700 can also be coupled to a computer 300. Each of the lighting devices 100A and 100B can be implemented as described above. A system with two lighting devices is shown for simplicity. Larger systems with more lighting devices can readily be implemented within the scope of the present invention.

The exemplary embodiment of the central controller 700 shown in FIG. 7 comprises an operator interface panel (OIP) 750, a power supply 710, a plurality of switches 720 and a data selector 730. The OIP 750 includes a microcontroller (not shown) which provides the intelligence of the central controller 700 and provides a user interface at the central controller. The lighting system can be controlled from the OIP 750 or from the external computer 300. The computer 300 can be temporarily coupled to the central controller 700 in order to program the OIP 750. Once programmed, the OIP 750 can then take over operation of the lighting system in accordance with the downloaded program.

The central controller 700 is coupled to the lighting devices 100A and 100B via respective data interfaces 120A, 120B. In an exemplary embodiment, the interfaces 120A, 120B are bidirectional serial data interfaces which conform to the RS-485 protocol. The lighting devices 100A and 100B are also coupled to the power supply 710 which provides DC power to the lighting devices. The power supply 710 may be coupled to a 115–120 V, 50–60 Hz AC power source (not shown) or other suitable power source.

The central controller 700 also includes interfaces 320A, 320B and 705 for coupling to the computer 300. The interfaces 320A and 320B are similar to the interfaces 120A and 120B and are used by the computer 300 to communicate with the lighting devices 100A and 100B, respectively. The data selector 730 is coupled to the lighting devices 100A, 100B via the interfaces 120A and 120B, to the computer 300 via the interfaces 320A and 320B, and to ports A and B of the OIP 750. The ports A and B of the OIP 750 are compatible with the interfaces 120A and 120B. Under the control of the OIP 750, the data selector 730 couples the lighting devices 100A, 100B to either the computer 300 or to the OIP 750. The interfaces associated with the respective lighting devices 100A and 100B may be switched by the selector 730 in tandem or individually. Thus, depending on the state of the selector 730, the lighting devices 100A, 100B may communicate either with the computer 300 or with the OP 750 over the interfaces 120A, 120B, respectively.

An additional data interface 705 couples the computer 300 to the OIP 750. In an exemplary embodiment, the interface 705 is a bidirectional serial data interface which conforms to the RS-232 protocol. The interface 705 is used to program the OIP 750 from the computer 300 and to exchange data as needed.

As can be readily understood by a person of ordinary skill in the art, the interfaces 120A, 120B, 320A, 320B and 705 can be implemented in a variety of known ways, the specifics of which are matters of design choice. Moreover, in alternate embodiments, these data interfaces may be parallel interfaces or wireless (e.g., IR, RF).

The switches 720 are used to input various information and place the system into various modes under user control. For example, in an aircraft application, the switches 720 may include a decompression simulation activation switch which causes the system to enter an emergency lighting mode. Another switch may be included to simulate high-temperature conditions in which case the lighting is dimmed to reduce the possibility of over-heating.

Figure 8A:
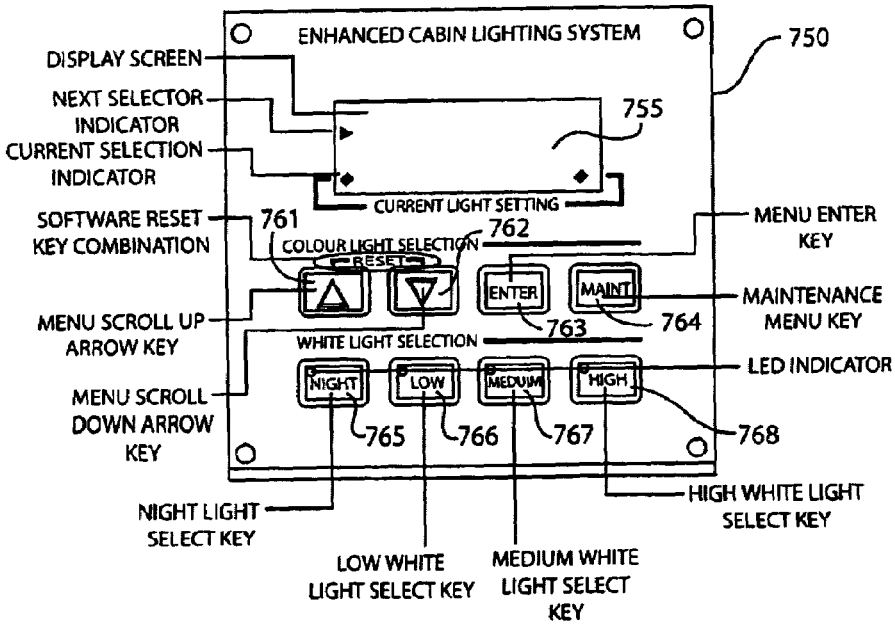

FIG. 8A shows the front panel of an exemplary embodiment of an OIP 750. The OIP 750 includes a display 755 and a plurality of buttons 761–768. A pair of buttons 761, 762 are used to scroll up and down a menu structure that is displayed on the display 755 and an ENTER button 763 is used to enter menu selections. A set of buttons 765–768 are used to control the generation of white light. FIG. 8B shows exemplary functions for the various buttons of the OIP 750.

The lighting system comprising the lighting devices 100A and 100B can be controlled from the OIP 750 of the central controller 700. A computer 300 can be coupled to the central controller 700 via the interface 705 to program the operation of the lighting system. The computer 300 can be loaded with software in accordance with the present invention which allows a user to create programs for the operation of the lighting system or to control the lighting system directly. The programs can be developed on the computer 300 off-line and then downloaded to the central controller 700 when coupled via the interface 750. The programs created on the computer 300 can control various operating characteristics of the lighting system such as the colors, intensities and durations of light to be emitted by the system. The computer 300 can also be used to create scenes or sequences of scenes, including transitions between scenes, fading, etc. The various lighting devices 100 coupled to the lighting system can operate independently of each other thereby allowing different lighting programs to be executed for different lighting areas.

FIG. 9 illustrates an exemplary user interface as displayed by the computer 300 programmed in accordance with the present invention. In the embodiment shown, independent control of ceiling and sidewall lighting is provided. A first area 500 of the display is used to display and control parameters related to the ceiling lighting and a second, similar area 600 is provided for the sidewall lighting.

Each area 500, 600 includes three slider widgets 551, 552 and 553 with corresponding data windows 561, 562, 563. The sliders 551, 552, and 553 are used to control the relative intensities of the red, green and blue light, respectively, emitted from the one or more lighting devices 100 that provide the ceiling light (or sidewall light, in the case of area 600). The data windows 561, 562 and 563 display numerical values corresponding to the settings selected by the sliders and provide an alternate means of entering and/or modifying said values. The widgets used in the present invention such as the sliders and data windows are well known functions and need no further description. Other suitable widgets or constructs may also be used. In an alternative embodiment, a two-dimensional color palette can be provided. The user can select the desired color by placing a cursor over the desired color point in the palette and selecting that point.

Below the color selection widgets within each area 500 (600) are four windows 572–575 that allow the user to specify additional parameters that affect the operation of the respective lighting devices. A "transition type" window 572 allows the user to select, from a pull down menu, one of five transition modes which determine how the color of the light emitted will vary over a certain transition period. The number of different colors which the emitted light will take on over the transition period is specified by the user via a "max colors" window 573. In an exemplary embodiment, 1 to 10 colors can be specified via window 573. Each of these colors is automatically assigned a number between 1 and the number specified in the window 573, with the numbers being assigned in the order of appearance. Each color can be selected by entering its assigned number in the "active color" window 574. The color selected via the window 574 can be adjusted via the widgets 551–553 or 561–563. Finally, a "time" window 575 is provided whereby the user can specify the duration of the transition period.

Figure 10A:
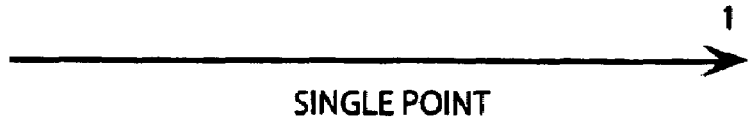
FIGS. 10A through 10E illustrate various lighting transition modes of an exemplary embodiment of a lighting system in accordance with the present invention.

To better illustrate the operation of this aspect of the present invention, an exemplary scene programming sequence will now be described. The user first enters a name for the scene to be created using a label window 800. Using the sliders 551–553 (or windows 561–563) the user specifies a first color to be generated in a color transition procedure which may have one or more steps. The user then selects one of five available transition types which are illustrated schematically in FIGS. 10A through 10E. The first available transition type referred to as "single point" yields a smooth transition from the present color to the specified color (color 1) in one continuous step, as represented in FIG. 10A. In this mode, the "max colors" window 573 and "active color" window 574 are fixed at one and cannot be altered by the user.

Figure 10B:
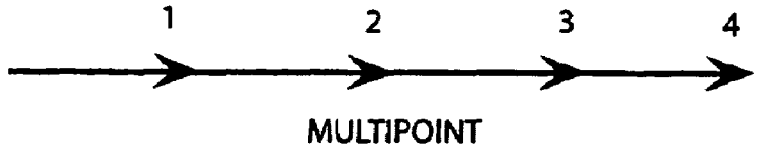

The second available transition type referred to as the "multipoint" transition mode is illustrated in FIG. 10B. This mode yields a smooth transition from selected color to selected color in a number of steps divided evenly over the time period specified in the time window 575. The number of steps (colors) through which this mode transitions is selected via the max colors window 573. FIG. 10B illustrates the case of four colors.

Figure 10C:
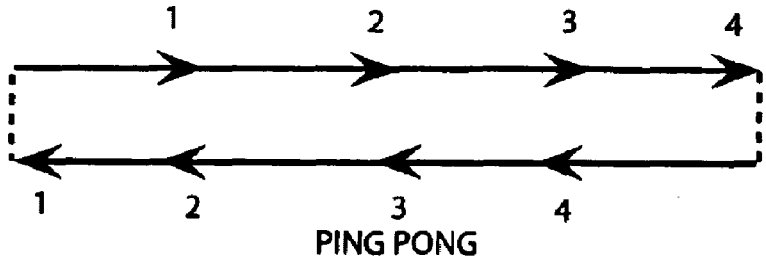

The third available transition type, referred to as the "ping pong" transition mode is illustrated in FIG. 10C. In this mode, a multipoint transition is followed by a multipoint transition through the same colors in reverse order.

Figure 10D:
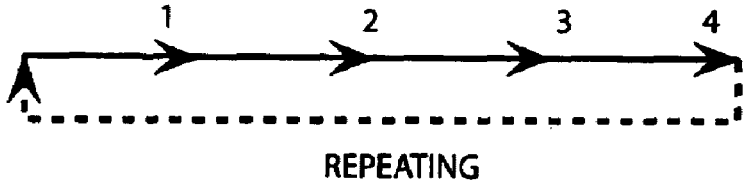

The fourth available transition type, referred to as the "repeating" transition mode is illustrated in FIG. 10D. In this mode, a multipoint transition is repeated in the same order.

Figure 10E:
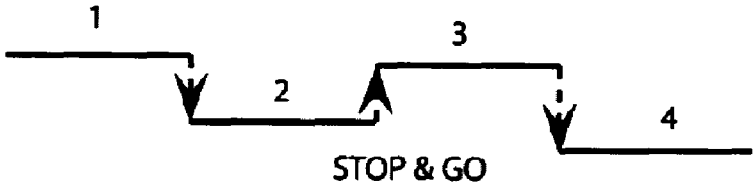

The last available transition type, the "stop and go" transition mode, is illustrated in FIG. 10E. This mode yields abrupt transitions from selected color to selected color. Each selected color is emitted for a period of time equal to the time period selected via the widget 575 divided by the number of colors selected via the widget 574.

The settings programmed via the screen of FIG. 9 can be given a name or label which is entered in the label window 800. During normal operation of the lighting system, the programmed settings can be invoked via the OIP 750 using the label provided in the label window 800. When a settings label is selected at the OIP 750, the settings associated with the label are put into effect.

As shown in FIG. 9, a set of "page control" buttons 801–805 is provided for controlling the programming of additional scenes, each of which can be programmed as described. When the "Add" button 805 is pressed, a new scene is created. A scene can be deleted with the "delete" button 801 and the previous and next buttons 802 and 803, respectively, can be used to sequence through multiple scenes. The settings window for each scene also can be accessed by a tab 820 arranged proximate to the top of the main window. In an exemplary embodiment, up to 15 scenes can be created and programmed individually as described. The sequence of scenes can be saved as a program on the computer 300. The program can then be downloaded from the computer 300 to the central controller 700 via the interface 705 and then executed by the lighting system, with or without the computer 300 coupled thereto. The execution of the downloaded program can be controlled by a user via the OIP 750.

The lighting system can be programmed to enter different modes under certain conditions. For example, during an emergency, the lighting system can turn off all LEDs with the exception of a subset of red LEDs located proximate to an emergency exit door. In another embodiment, the red LEDs can be sequenced so as to indicate the path to an emergency exit door. Other conditions that can cause the system to enter a special mode of operation may include, among others, the loss of main power and the switching over to backup power.

Several exemplary physical configurations of the lighting devices of the present invention will now be described.

Figure 11:
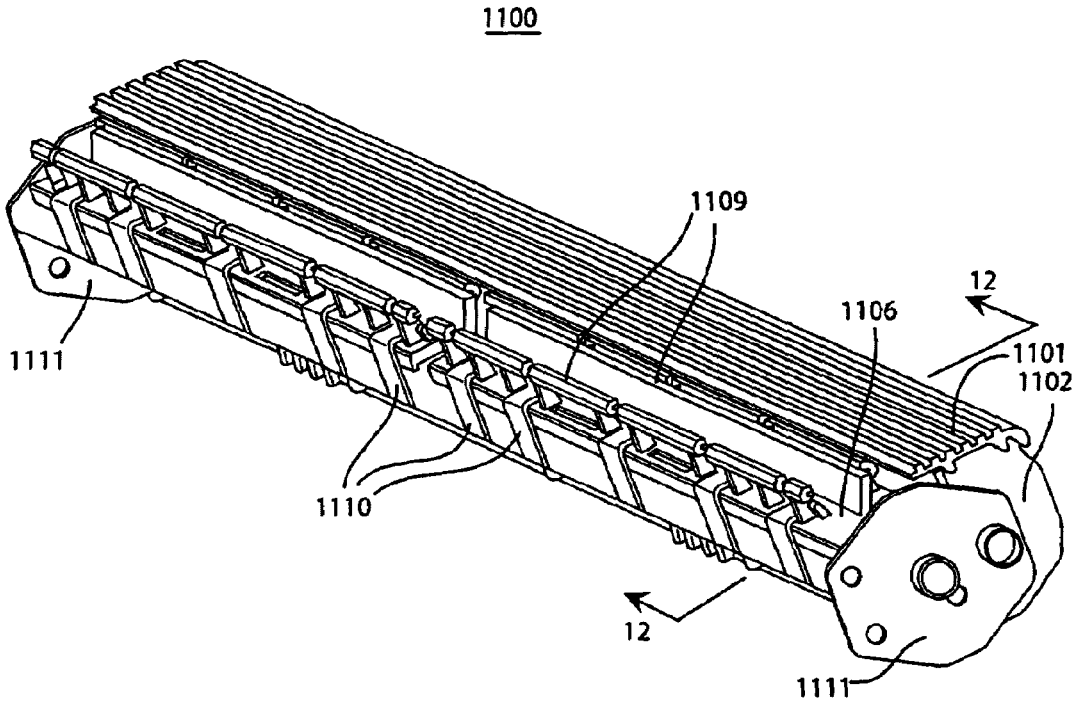
FIG. 11 shows a first exemplary embodiment of a lighting device in accordance with the present invention.
Figure 12:
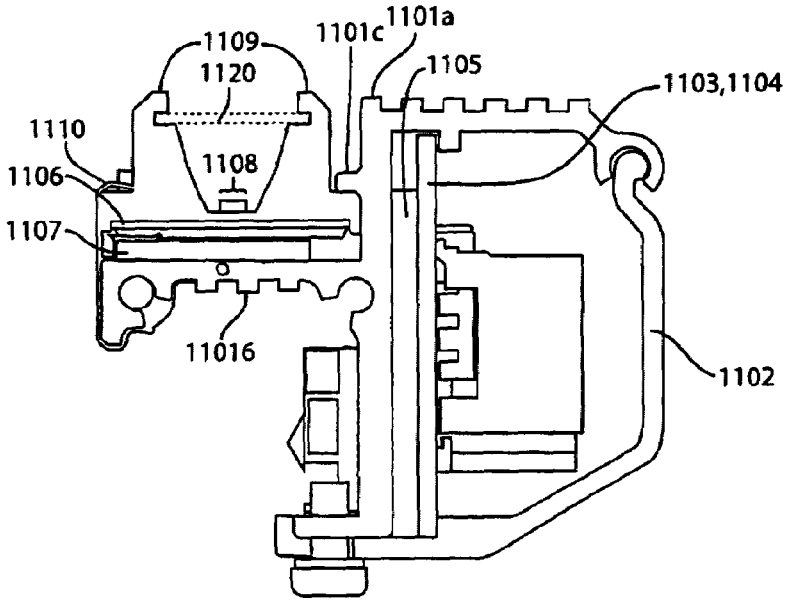
FIG. 12 shows a cross-sectional view of the device of FIG. 11.

FIG. 11 is a perspective view of the exterior of a first exemplary embodiment of a lighting device 1100 in accordance with the present invention. FIG. 12 is a view of cross section A—A of the device of FIG. 12. As shown, the device 1100 has a generally linear configuration with a generally rectangular cross-section. The device 1100 comprises an extruded metallic (e.g., aluminum) housing 1101 which in combination with a side cover 1102 forms a first compartment containing a circuit board 1103 for the control module and a circuit board 1104 for the power module. The boards 1103 and 1104 are arranged end-to-end in the same plane against a central wall 1101*a* of the housing extrusion 1101 with a layer of thermal padding 1105 arranged between the boards and the housing extrusion. The thermal padding 1105 may comprise any suitable material for conducting heat generated by the boards to the housing extrusion.

A third circuit board, an LED board 1106, is supported on a platform-like structure 1101*b* which protrudes substantially perpendicularly from the central wall 1101*a* of the housing extrusion 1101. A layer of thermal padding 1107 is arranged between the bottom of the LED board 1106 and the top of the platform-like structure 1101*b* for conducting heat from the LED board to the housing extrusion 1101. The LED board 1106 preferably includes one or more layers of metallic material (not shown) as well as islands of metallic material (not shown) on its top and bottom surfaces for the purpose of conducting heat away from the LEDs to the platform-like structure 1101*b* of the housing extrusion through the thermal padding 1107. The housing extrusion 1101 preferably includes groove-like features 1101*d* which increase its surface area and thus aid in the dissipation of heat from the housing.

A row of LEDs 1108 is arranged substantially down the center of the upper surface of the LED board 1106 along the length of the LED board. (See FIG. 2 for a plan view of the LED board.) As shown in FIG. 12, a reflector 1109 is arranged on either side of the row of LEDs. The two reflectors 1109 form a trough between them having a generally parabolic cross-section with the row of LEDs 1108 being arranged at the bottom of the trough. Light emitted from the LEDs 1108 is reflected by the inner surfaces of the reflectors 1109. The inner surfaces of the reflectors are smooth and may be specular. An optional cover plate 1120 may be arranged between the reflectors 1109 across the trough formed therebetween. The cover plate 1120 may be transparent or translucent and may be tinted.

The reflectors 1109 are attached to the LED board 1106, such as by riveting or other appropriate attachment arrangement, thereby forming an LED board sub-assembly. The right edge of the LED board sub-assembly is retained by a lip 1101*c* protruding from the central wall 1101*a* of the housing extrusion whereas the left edge of the LED board sub-assembly is retained by a plurality of clips 1110 arranged along the length of the fixture.

As shown in FIG. 11, end caps 1111 are attached to the ends of the housing extrusion 1101 for fixedly mounting the device 1100 such as to the interior of an aircraft cabin.

In an exemplary embodiment, the device 1100 is one to five feet in length. The cross-sectional dimensions of the exemplary device shown are approximately 1.75"×1.75".

Figure 13:
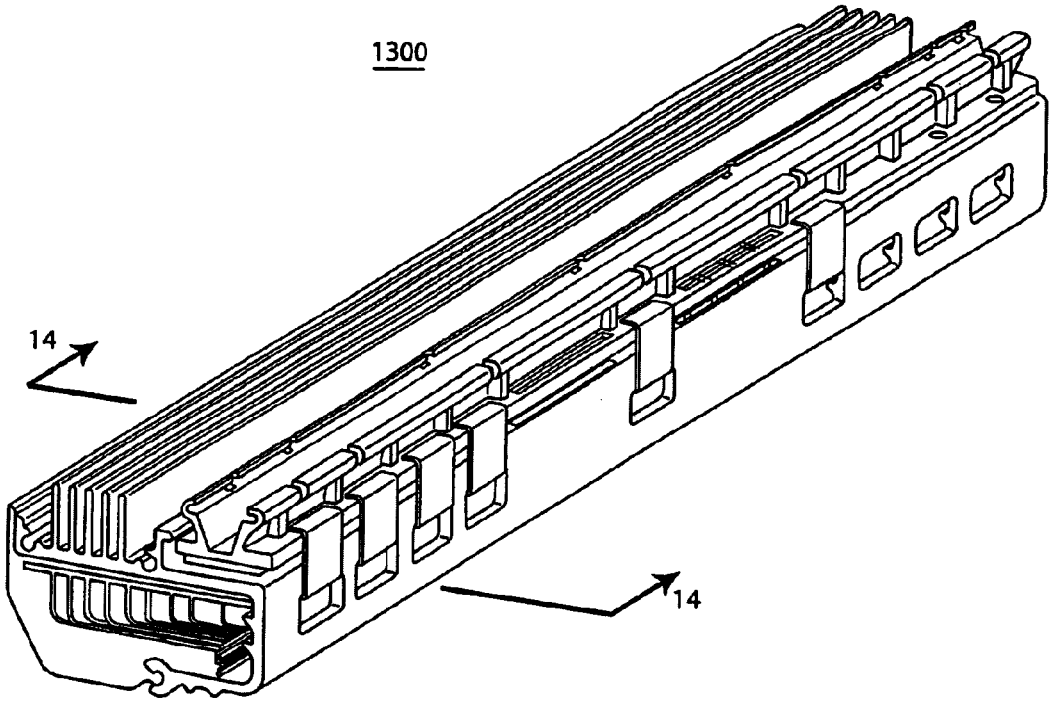
FIG. 13 shows a second exemplary embodiment of a lighting device in accordance with the present invention.
Figure 14:
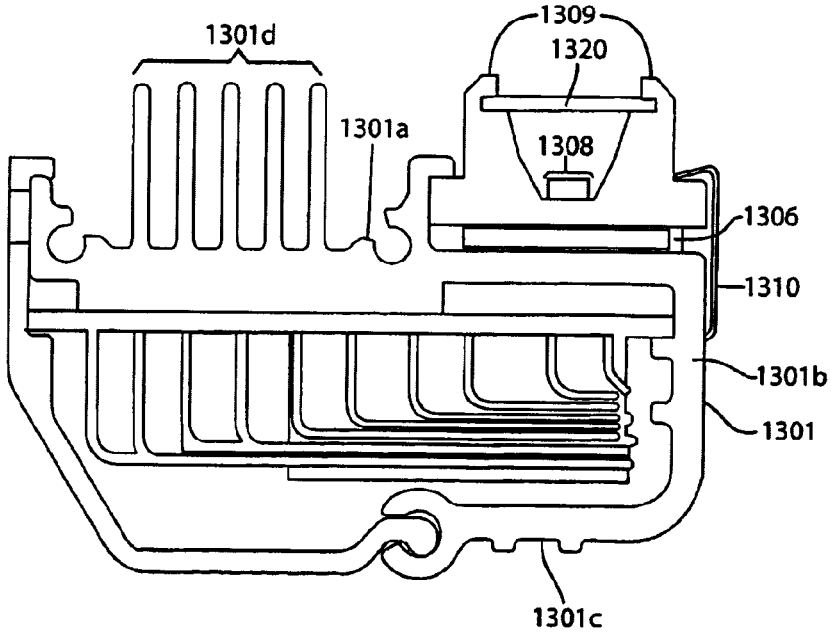
FIG. 14 shows a cross-sectional view of the device of FIG. 12.

FIGS. 13 and 14 show a further exemplary embodiment of a lighting device 1300 in accordance with the present invention. The various components of the device 1300 are similar to those of device 1100, with the primary differences being the shape of the metallic housing extrusion 1301 and the arrangement of components. As shown in FIG. 14, the housing extrusion 1301 of device 1300 comprises an upper horizontal wall 1301*a*, with a vertical wall 1301*b* extending downwards from the right edge of the upper wall and a bottom wall 1301*c* extending horizontally from the bottom edge of the vertical wall. Cooling fins 1301*d* may be formed in the outer surface of the upper wall 1301*a* and serve to dissipate heat from the device to the surrounding air.

An LED board assembly 1306, 1308, 1309, similar to that of device 1100, is removably attached by multiple clips 1310, in a similar manner, to the outer surface of the upper wall adjacent to the right edge of the upper wall.

A control board 1303 and a power board 1304 are arranged end-to-end against the inner surface of the upper wall.

Exemplary cross-sectional dimensions of device 1300 are approximately 1.5" high and 2" wide.

Figure 15:
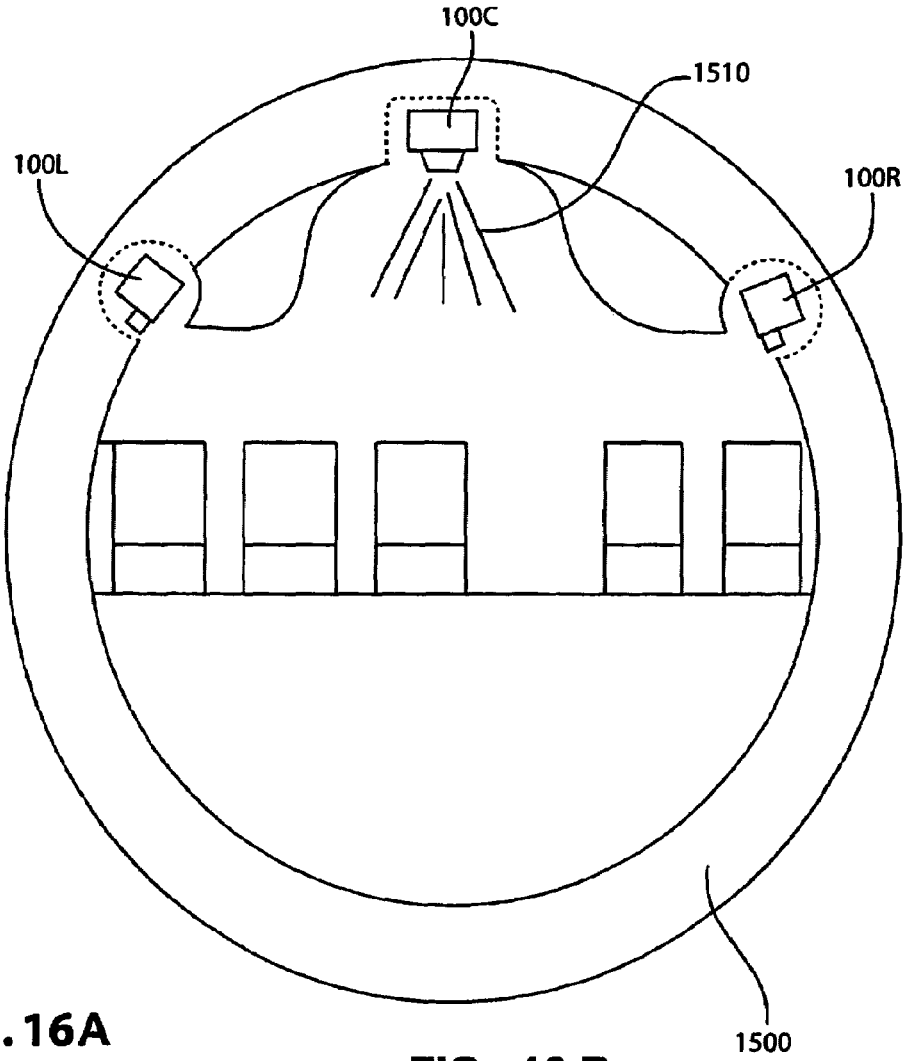
FIG. 15 shows a cross-sectional view of an aircraft passenger cabin illustrating the placement of lighting devices of the present invention within the aircraft passenger cabin.

FIG. 15 shows a cross-section of an aircraft 1500 illustrating exemplary placements for lighting devices 100 of the present invention for illuminating the passenger cabin 1510 of the aircraft. In the exemplary arrangement shown, a lighting device 100C is placed in the ceiling of the passenger cabin and provides ceiling lighting. Lighting devices 100L and 100R are placed to illuminate the left and right sidewalls, respectively, of the passenger cabin. The three devices 100C, 100L and 100R can be coupled to one or more central controllers 700 and programmed as described above.

Figure 16A:
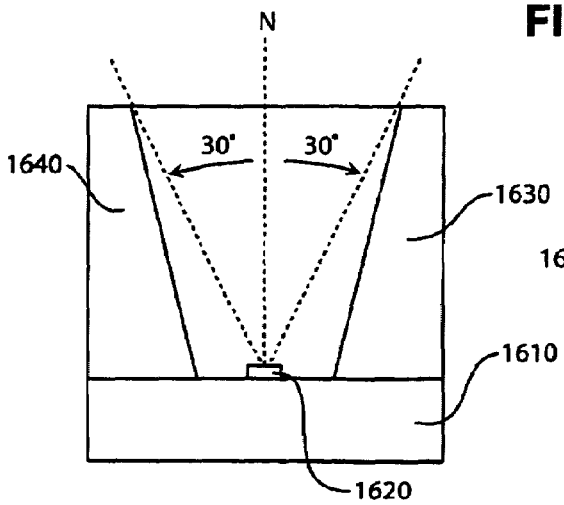
FIGS. 16A through 16C show cross-sectional views of three exemplary reflector arrangements of a lighting module of a lighting device of the present invention.

Exemplary embodiments of reflector arrangements in accordance with the present invention will now be described in connection with FIGS. 16–16C. FIGS. 16A–16C show cross-sectional views of three different reflector arrangements for use in different applications. In FIG. 16A, reflectors 1640 and 1630 are arranged on either side of a row of LEDs 1620 arranged along the length of a circuit board 1610. As shown in FIG. 16A, the cross-sections of the reflectors 1630 and 1640 are mirror images of each other. Light is emitted from the LEDs 1620 and reflected by the reflectors 1630, 1640 in a pattern that is symmetric about the LEDs. A normal line N corresponds substantially to the center of the light that is emitted from the LEDs. In an exemplary embodiment, the cross-section of the pattern of light emitted by the LED/reflector assembly has an included angle of 60 degrees, with 30 degrees on each side of the normal line N. Such a pattern is well suited for illuminating the sidewall of an aircraft cabin, for example.

Figure 16B:
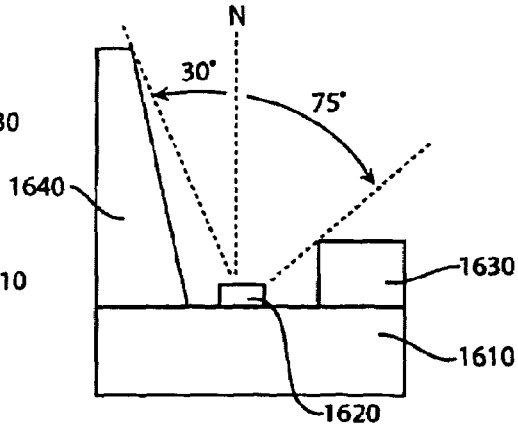
Figure 16C:
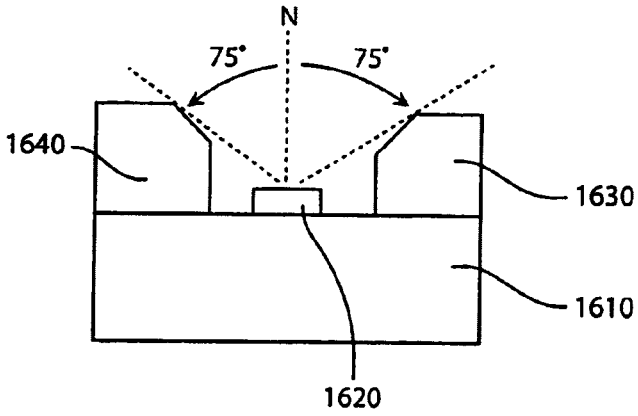

In the arrangement shown in FIG. 16B, the reflector 1630 is substantially shorter than the reflector 1640. As a result, light is emitted from the LEDs 1620 and reflected by the reflectors 1630, 1640 in a pattern that is asymmetric about the LEDs. In an exemplary embodiment, the cross-section of the pattern of light emitted by the LED/reflector assembly has an included angle of 105 degrees, with 30 degrees on the left side of the normal line N and 75 degrees on the right side. Such a pattern is well suited for ceiling illumination in an aircraft cabin, for example.

In the arrangement shown in FIG. 16C, the reflectors 1630 and 1640 have mirror-image cross-sections but are both substantially shorter than the reflectors of FIG. 16A. As a result, light is emitted from the LEDs 1620 and reflected by the reflectors 1630, 1640 in a pattern that is symmetric about the LEDs but which has a wider included angle than the embodiment of FIG. 16A. In an exemplary embodiment, the cross-section of the pattern of light emitted by the LED/reflector assembly has an included angle of 150 degrees, with 75 degrees on each side of the normal line N. Such a pattern is well suited for ceiling illumination in an aircraft cabin, for example.

In systems such as that of the present invention in which light of different colors is emitted from different point sources (LEDs) it is desirable to thoroughly blend the different color light to prevent the appearance of multiple light sources of different colors. For confined spaces such as an aircraft cabin, it is desirable that light rays of different colors be perceived as mixed at relatively small distances from the light fixture: e.g., one inch, as opposed to several yards for large outdoor display applications. To promote the mixing of light of different colors emitted from different point sources, the reflective surfaces of the reflectors 1630, 1640 preferably have a flat white finish, which tends to scatter the reflected light in multiple directions. A person looking at the lighting device will see the scattered light, which is mixed, and not the discrete LED point sources from which the light originated.

Figure 17A:
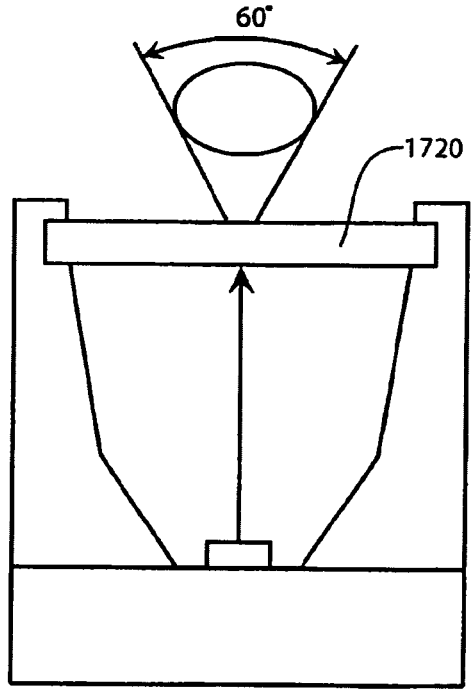
FIGS. 17A and 17B show how a ray of light is affected by two exemplary lens arrangements.
Figure 17B:
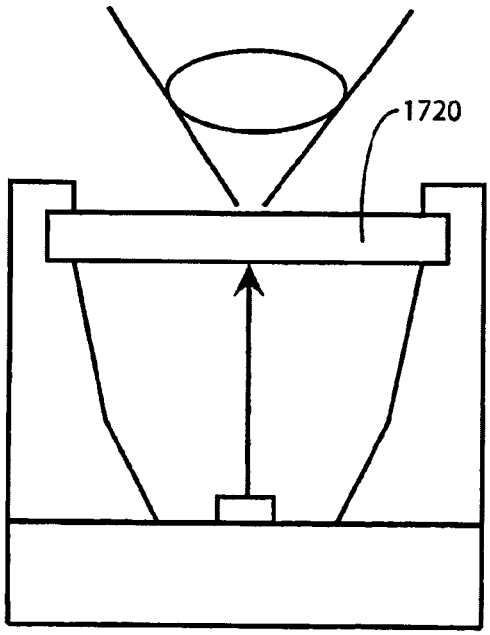

As discussed above in connection with FIGS. 12 and 14, a cover 1120 (1320) may be optionally arranged between the reflectors 1109 (1309) arranged on either side of the LEDs. The cover may be a lens which helps promote light mixing. As shown in FIGS. 17A and 17B, a ray of light passing through the cover 1720 is diffused into a cone, with a circular cross-section (FIG. 17A) or an elliptical cross-section (FIG. 17B). In an exemplary embodiment, the cover 1720 can be implemented with a sheet of polycarbonate material having a thickness of 0.030 inches.

The present invention is not to be limited in scope by the specific embodiments described herein. Indeed, various modifications of the invention in addition to those described herein will become apparent to those skilled in the art from the foregoing description and the accompanying figures. Such modifications are intended to fall within the scope of the appended claims.

It is further to be understood that all values are to some degree approximate, and are provided for purposes of description.

The disclosures of any patents, patent applications, and publications that may be cited throughout this application are incorporated herein by reference in their entireties.

What is claimed is:

1. A light emitting diode (LED) lighting device comprising:

a first group of LEDs of a first color;

a second group of LEDs of a second color;

a third group of LEDs of a third color; and a control circuit, the control circuit being coupled to each of the groups of LEDs and comprising a data interface, wherein the control circuit independently controls each group of LEDs in accordance with data received at the data interface and includes:

a processor, the processor being coupled to the data interface, and a controllable current source for each group of LEDs, the controllable current source being controlled by the processor, wherein:

each group of LEDs comprises a plurality of LED strings coupled in parallel, each LED string comprising one or more LEDs coupled in series, and at least one of the first, second and third groups of LEDs includes one or more ballast LEDs, and the light emitted from each of the one or more ballast LEDs is obscured from combining with light emitted by other LEDs in the first, second and third groups of LEDs.

2. The LED lighting device of claim 1, wherein:

each LED string has a forward voltage that is a function of the number of LEDs in the LED string; and the number of LEDs and ballast LEDs in each LED string is selected so that the forward voltages of all LED strings are substantially the same.

3. The LED lighting device of claim 1, wherein the first, second and third colors are selected from the group of colors consisting of red, orange, green and blue.

4. The LED lighting device of claim 1, wherein the first, second and third colors have respective wavelengths that are at least 30 nm apart.

5. A lighting system comprising the LED lighting device of claim 1 and a central controller coupled to the LED lighting device.

6. The lighting system of claim 5 comprising an additional LED lighting device.

7. The LED lighting device of claim 1, wherein the first, second and third groups of LEDs are arranged substantially along a line so that LEDs of the same LED string are separated by one or more LEDs of a different LED string.

8. A light emitting diode (LED) lighting device comprising:

a first group of LEDs of a first color;

a second group of LEDs of a second color;

a third group of LEDs of a third color;

a control circuit, the control circuit being coupled to each of the groups of LEDs and comprising a data interface, wherein the control circuit independently controls each group of LEDs in accordance with data received at the data interface and includes:

a processor, the processor being coupled to the data interface, a controllable current source for each group of LEDs, the controllable current source being controlled by the processor, and a current monitor for each group of LEDs, the current monitor monitoring the current through its respective group of LEDs and providing a reading of the current to the processor, and a power circuit, the power circuit being coupled to each of the groups of LEDs and to the control circuit, and including a variable power supply, the variable power supply generating a voltage whose magnitude is controlled by the processor, wherein:

each group of LEDs comprises a plurality of LED strings coupled in parallel, each LED string comprising one or more LEDs coupled in series, and the processor controls the variable power supply to adjust a voltage $V_{Reg}$ supplied at a common anode of each of the plurality of LED strings to set the voltage $V_{Reg}$ at a lowest level required to produce a first predetermined current for the first group of LEDs, a second predetermined current for the second group of LEDs and a third predetermined current for the third group of LEDs, wherein the currents produced by each of the first, second and third groups of LEDs as respectively measured by the current monitor of each of the first, second and third groups.

9. The lighting system of claim 8, wherein the central controller includes:

an operator interface panel;

a computer interface; and a switch for selectively coupling the operator interface panel and the computer interface to the LED lighting device.

10. The LED lighting device of claim 8, wherein the processor controls the variable power supply to incrementally increase the voltage $V_{Reg}$ over a low range value until the measured currents for each of the first, second and third groups of LEDs respectively equal or exceed the first, second and third predetermined currents.

11. The LED lighting device of claim 8, wherein each predetermined current value represents a nominal current value for its respective group.

12. The LED lighting device of claim 11, wherein each nominal current value is a determined as a function of the number of LED strings in its respective group and the number of LEDs in each string of the respective group.

* * * * *